US006415514B1

(12) United States Patent
Chun

(10) Patent No.: US 6,415,514 B1
(45) Date of Patent: Jul. 9, 2002

(54) ARTISTIC KNIFE WITH REPLACEABLE BLADE MAGAZINE

(76) Inventor: Tseng Min Chun, Taichung (TW)

( * ) Notice: Subject to any disclaimer, the term of this patent is extended or adjusted under 35 U.S.C. 154(b) by 0 days.

(21) Appl. No.: 09/632,302

(22) Filed: Aug. 3, 2000

(51) Int. Cl.[7] ..... B26B 1/08; B26B 29/00
(52) U.S. Cl. ..... 30/162; 30/40.1; 30/335
(58) Field of Search ..... 30/162, 334, 335, 30/336, 340, 125, 151, 40, 40.1

(56) References Cited

U.S. PATENT DOCUMENTS

| | | | | | |
|---|---|---|---|---|---|
| 2,172,072 | A | * | 9/1939 | Rothschild | 30/162 X |
| 3,577,637 | A | * | 5/1971 | Braginetz | 30/162 |
| 3,708,881 | A | * | 1/1973 | Bennett | 30/335 X |
| 4,277,888 | A | * | 7/1981 | Szabo | 30/162 |
| 5,099,578 | A | * | 3/1992 | Jan | 30/162 |
| 5,404,645 | A | * | 4/1995 | Janser | 30/125 |
| 5,435,062 | A | * | 7/1995 | Huang | 30/125 |
| 5,644,843 | A | * | 7/1997 | Young | 30/162 X |
| 5,906,050 | A | * | 5/1999 | Gilbert | 30/162 |
| 5,960,545 | A | * | 10/1999 | Shepherd et al. | 30/125 |
| 5,966,817 | A | * | 10/1999 | Lee | 30/162 |
| 6,101,721 | A | * | 8/2000 | Medhurst | 30/125 |
| 6,148,522 | A | * | 11/2000 | Dobandi | 30/162 |

FOREIGN PATENT DOCUMENTS

| | | | | | |
|---|---|---|---|---|---|
| GB | 2213416 | A | * | 8/1989 | 30/162 |

* cited by examiner

*Primary Examiner*—Charles Goodman
(74) *Attorney, Agent, or Firm*—Rosenberg, Klein & Lee

(57) ABSTRACT

An artistic knife with replaceable blade magazine, including a handle formed with a receptacle on one side in which a blade magazine is inserted. The magazine is formed with an internal reservoir in which several overlapped blades are placed. A pushing member is slidable within the reservoir. The pushing member is formed with a stop wall for abutting against the rear end of the blade. An upper edge of front end of the blade magazine is an opening through which the uppermost blade in the reservoir and the pushing member are pushed out. A blade seat is back and forth movably disposed on inner face of the handle. One side of the blade seat is formed with a blade cavity. A latch hook is disposed on upper side of the blade cavity. The top edge of the blade is formed with at least one notch for the hook section of the latch hook to hook in. The blade seat is controlled by a pushing member to move forward or backward to make a blade extend out of the handle for use. By means of pressing a press button, the hook section is forced to separate from the notch of the blade for taking out the blade.

6 Claims, 16 Drawing Sheets

ARTISTIC KNIFE WITH REPLACEABLE BLADE MAGAZINE

BACKGROUND OF THE INVENTION

The present invention relates to an artistic knife with replaceable blade magazine, in which several blades are loaded in a blade magazine which is installed on the handle of the knife. By means of the replaceable blade magazine, blade can be more easily replaced with less time.

FIGS. 9 and 10 show a conventional artistic knife having a blade reservoir 51 on one side of the handle 5 of the artistic knife. After a blade is worn off, a new blade can be immediately supplied and used instead of the worn blade.

The blade 6 is formed with two notches 61 and two locating sections 511 are disposed in the blade reservoir 51 corresponding to the notches 61 for restricting the blade 6. A blade seat 7 is disposed on inner side of the handle corresponding to the blade reservoir 51. The upper edge of the blade seat 7 is punched with a resilient engaging plate 71 slightly protruding from the blade seat to insert into the notches 61 of the blade so as to fix the innermost blade 6*a* in the blade reservoir 51. A push button 72 disposed on the blade seat 7 is used to forward move the blade to the front end of the handle. In order to detach the blade, a press key 52 is disposed on the handle 5 for pushing the resilient engaging plate 71 to separate from the notches 61 of the blade.

Such design has some shortcomings. For example, the blades 6 must be loaded in the blade reservoir 51 of one side of the handle. After the blades 6 are exhausted, it is necessary to load the blades one by one after detaching a stop board 54 and a resilient push section 53. Such procedure is troublesome.

In addition, the resilient engaging plate 71 of the blade seat 7 slightly protrudes from the inner edge of the blade seat 7 as shown in FIG. 11. In order to effectively engage the engaging plate 71 with the blade, the protruding distance t is set to be about the thickness of the blade. However, an error in manufacturing may make it impossible to insert the blade seat with the blade or make the blade seat insert with two blades at the same time to clog the front end of the handle.

SUMMARY OF THE INVENTION

It is therefore a primary object of the present invention to provide an artistic knife with replaceable blade magazine, in which the blade magazine is independently installed on the handle of the knife for a user to quickly replace the blade. In addition, when armed, the artistic knife will not be clogged due to poor accuracy of the blade seat.

The present invention can be best understood through the following description and accompanying drawings wherein:

DETAILED DESCRIPTION OF THE PREFERRED EMBODIMENTS

Figure 1:
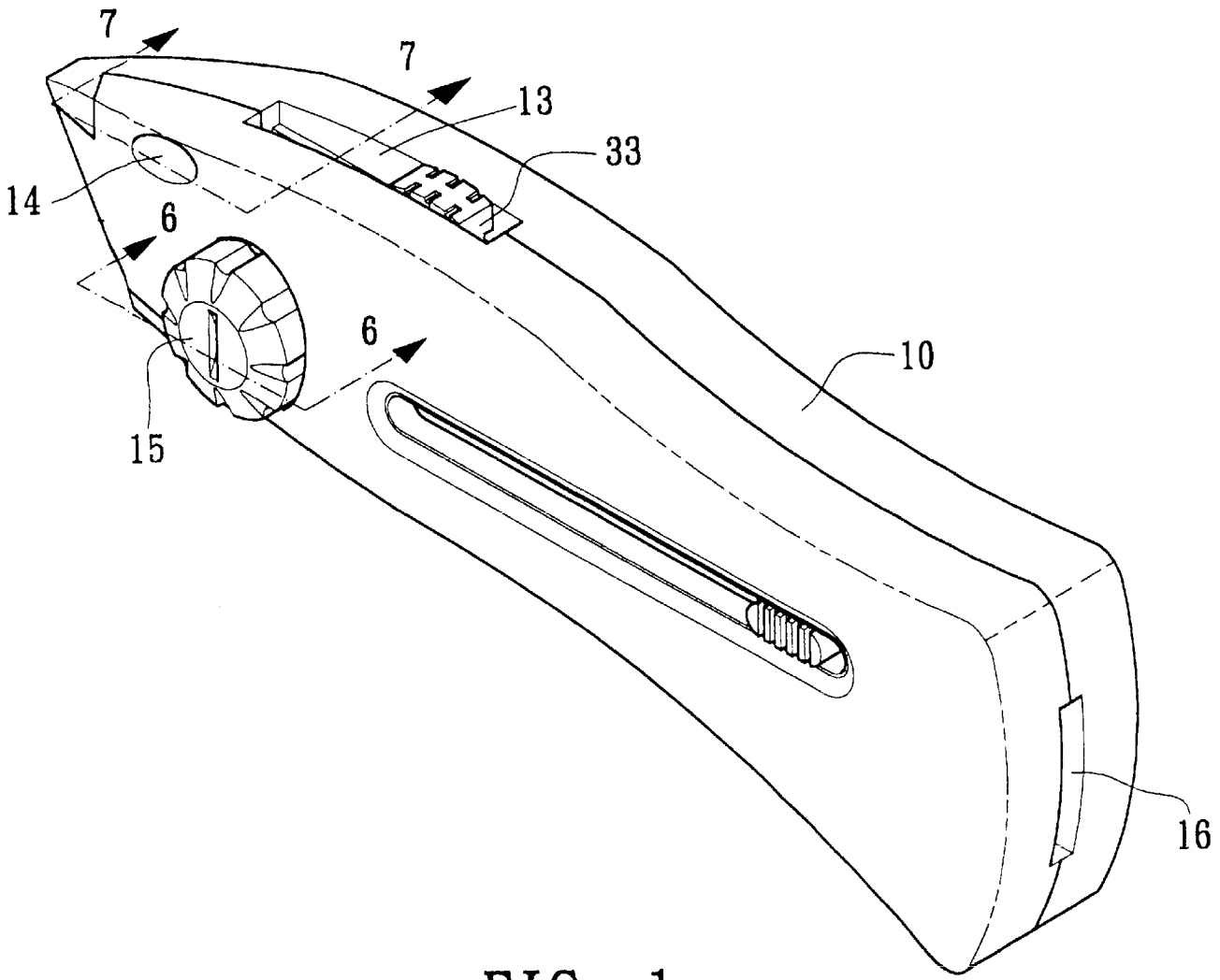
FIG. 1 is a perspective assembled view of the present invention.
Figure 2:
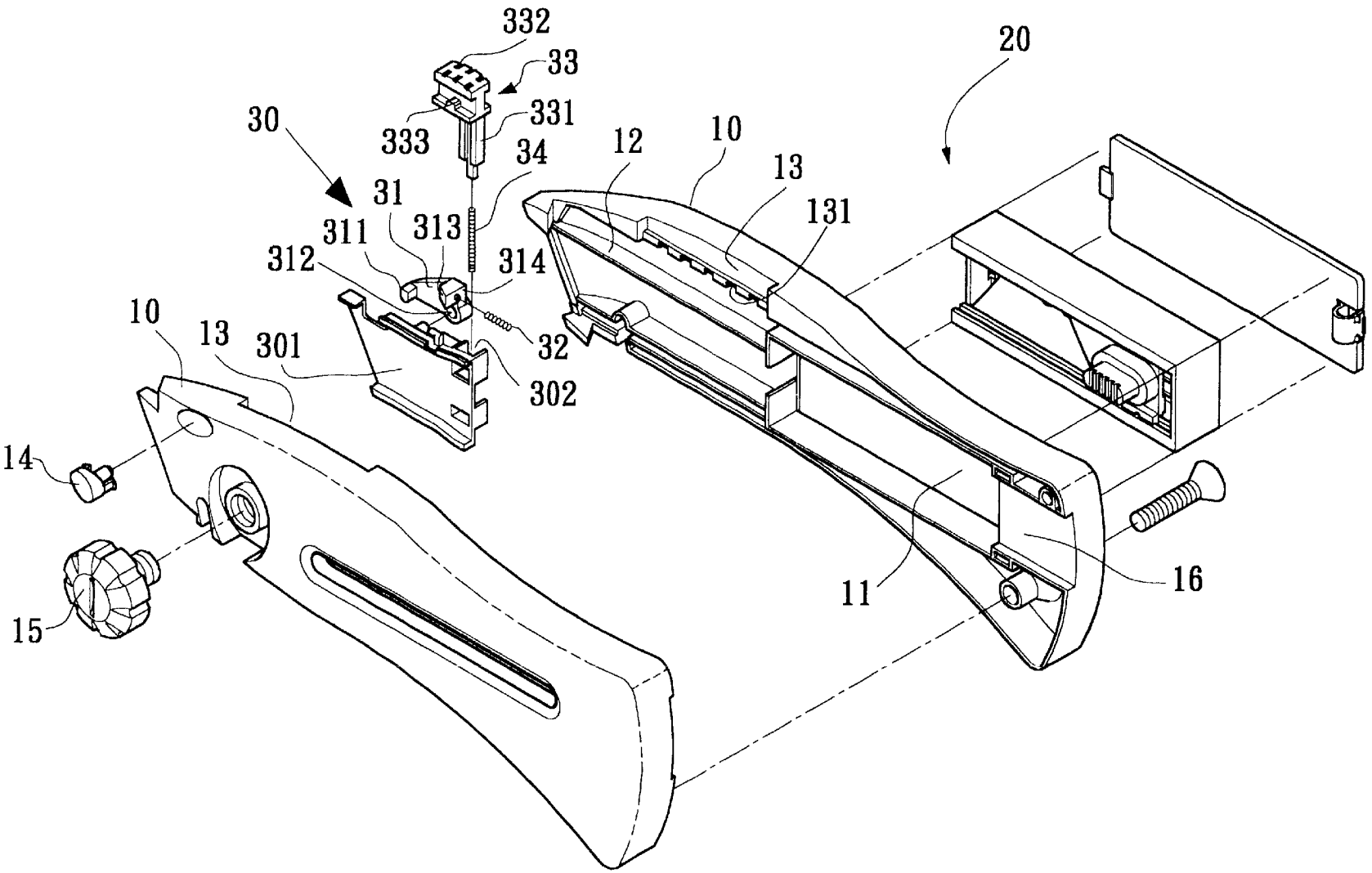
FIG. 2 is a perspective exploded view of the present invention.
Figure 3:
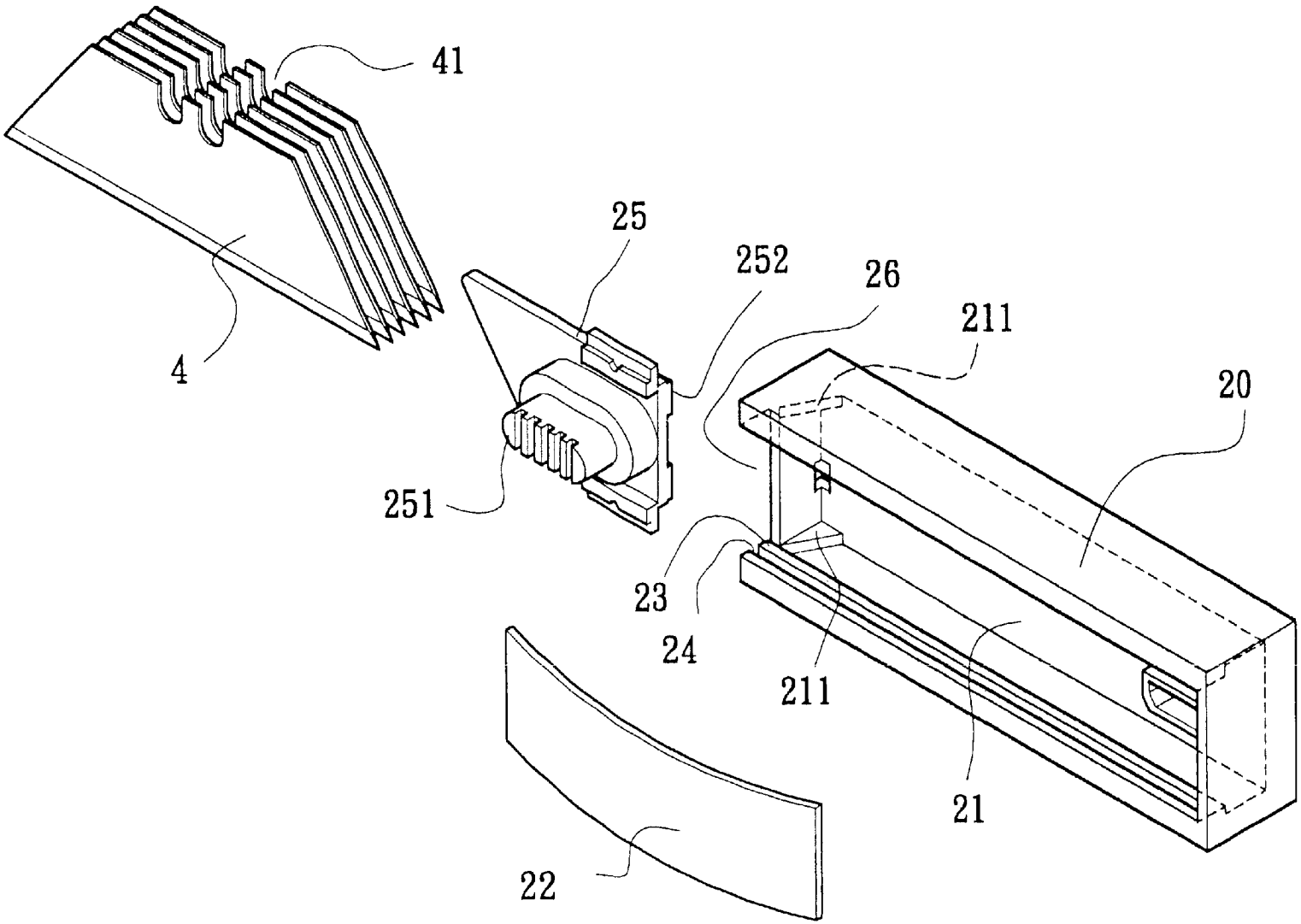
FIG. 3 is a perspective exploded view of the blade magazine of the present invention.

Please refer to FIGS. 1, 2, and 3. The artistic knife of the present invention includes a handle 10, a blade magazine 20, and a blade seat 30 installed in the handle 10. The blade magazine 20 supplies blades for the blade seat 30 on front side of the blade magazine 20.

Figure 4:
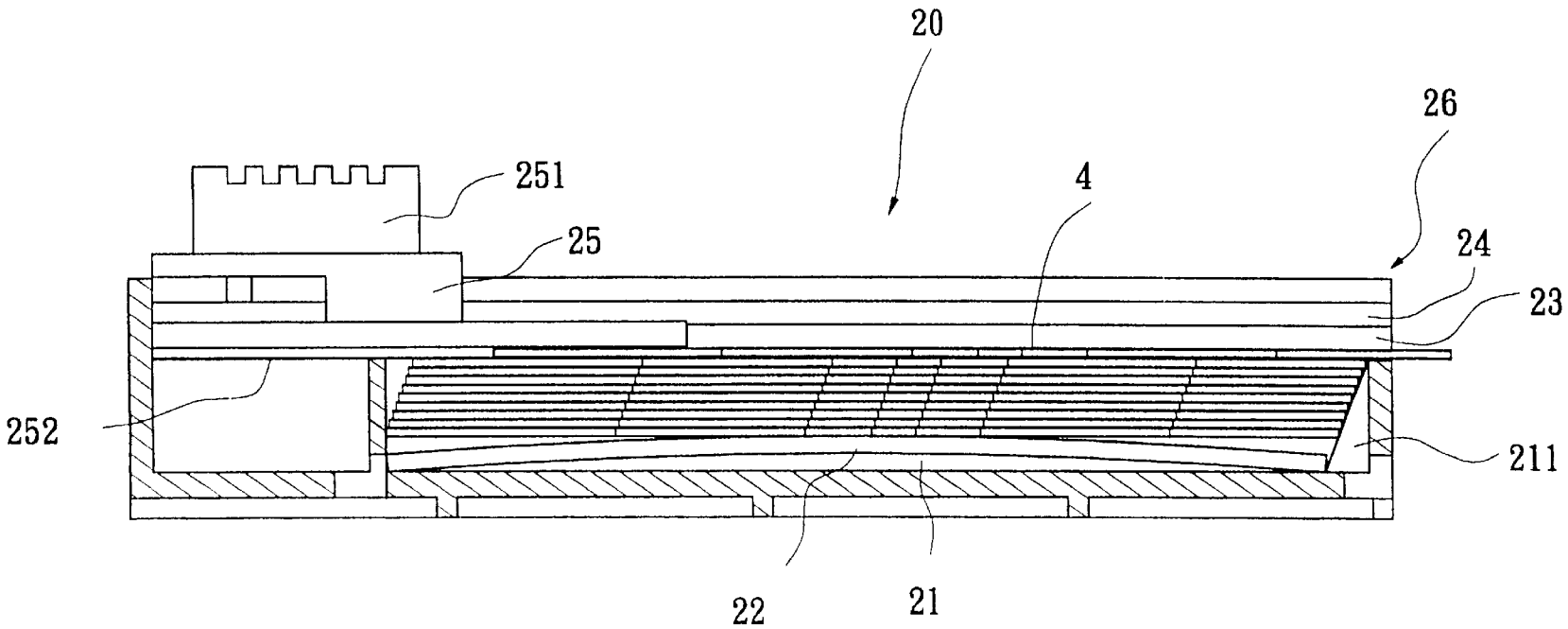
FIG. 4 is a sectional view taken along IV—IV of FIG. 3, showing the operation of the blade magazine of the present invention.

One side of the handle 10 is formed with a receptacle 11 in which the blade magazine 20 is inlaid from outer side thereof. The blade magazine 20 is formed with an internal reservoir 21 in which several overlapped blades 4 are placed. The reservoir 21 has an open side. A stop flange 23 is formed on the open side of the reservoir 21. The stop flange 23 inward extends from two sides and extends to front end and rear end of the blade magazine 20 and spaced from. the upper side of the top edge of the reservoir by a distance of the thickness of a blade. The front ends of two sides of the reservoir 21 of the blade magazine are respectively disposed with two slopes 211. The upper end of the slope 211 is positioned on top edge of the reservoir. The front edge of the blade is leant against the slope 211 to sequentially move forward to the front end of the blade magazine as shown in FIG. 4. A resilient plate 22 is disposed on the bottom of the reservoir 21 to make the uppermost blade upward pushed to the stop flange 23.

The upper edge of the stop flange 23 is disposed with a long channel 24 for a pushing member 25 to slide thereal-ong. The pushing member 25 is board-like. A lateral face thereof is formed with a projecting pushing block 251 extending to the outer side of the handle. The inner face of the pushing member 25 is disposed with a projecting stop wall 252 positioned at a position to abut against the rear end of the blade 4. The upper edge of front end of the blade magazine 20 is an opening 26 through which the uppermost blade in the reservoir and the pushing member are pushed out.

The inner face of the handle 10 is formed with an axial long slide way 12 along which the blade seat 30 is moved back and forth. One side of the blade seat 30 is formed with a blade cavity 301. The bottom of the blade cavity 301 corresponds to the plane face of the top edge of the reservoir 21 of the blade magazine. The blade cavity 301 has a diverging open end near the blade magazine 20. A latch hook 31 is disposed on upper side of the blade cavity 301. The top edge of the blade 4 is formed with at least one notch 41 for the hook section 311 of the latch hook 31 to hook in. The latch hook 31 is pivotally disposed on back side of the blade seat 30. A pushing section 314 is disposed on one side of the latch hook with the pivot shaft. The pushing section 314 is pushed by a spring 32 to keep the hook section 311 of the latch hook in an engaged position.

Figure 7:
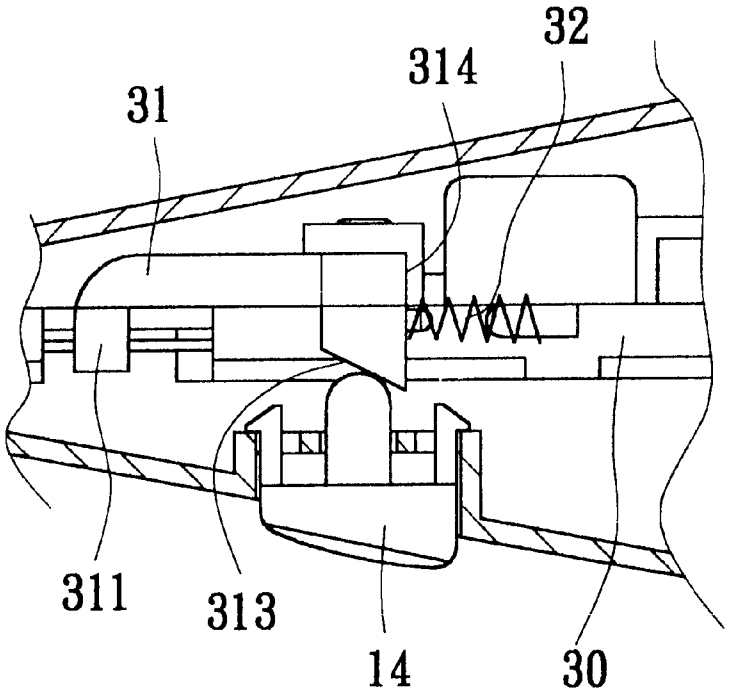
FIG. 7 is a sectional view taken along line VII—VII of FIG. 1, showing that the press button is pressed against the guide slope face.

A guiding slope face 313 is formed on one side of the latch hook with the pivot shaft 312. The pushing section 314 is positioned on a lateral side of the end section of the guiding slope face 313. The guiding slope face 313 and the swinging face of the latch hook 31 contain an angle. A press button 14 is disposed on outer edge of the handle 10 at the position of the guiding slope face 313. The press button 14 can be pressed against the guiding slope face 313 as shown in FIG. 7. When the guiding slope face 313 is pushed by the press button 14, the deflecting direction thereof makes the pushing section 314 push back the spring 32 to force the hook section 311 separate from the notch 41 of the blade.

The blade seat 30 is controlled by a pushing member 33 to move forward or backward. The top edge of the blade seat 30 is formed with a longitudinal guide channel 302 in which the pushing member 33 is installed. The pushing member 33 has a longitudinal bar 331 in which a spring 34 is positioned to up and down slide within the guide channel 302. The top section of the handle 10 is formed with a guide slot 13. A push button 332 is disposed at top end of the pushing member within the guide slot 13. The bottom edges of two sides of the guide slot 13 are disposed with multiple engaging dents 131 at intervals. Two sides of the push button 332 are formed with laterally extending projecting blocks 333 for engaging with the engaging dents 131.

Figure 5:
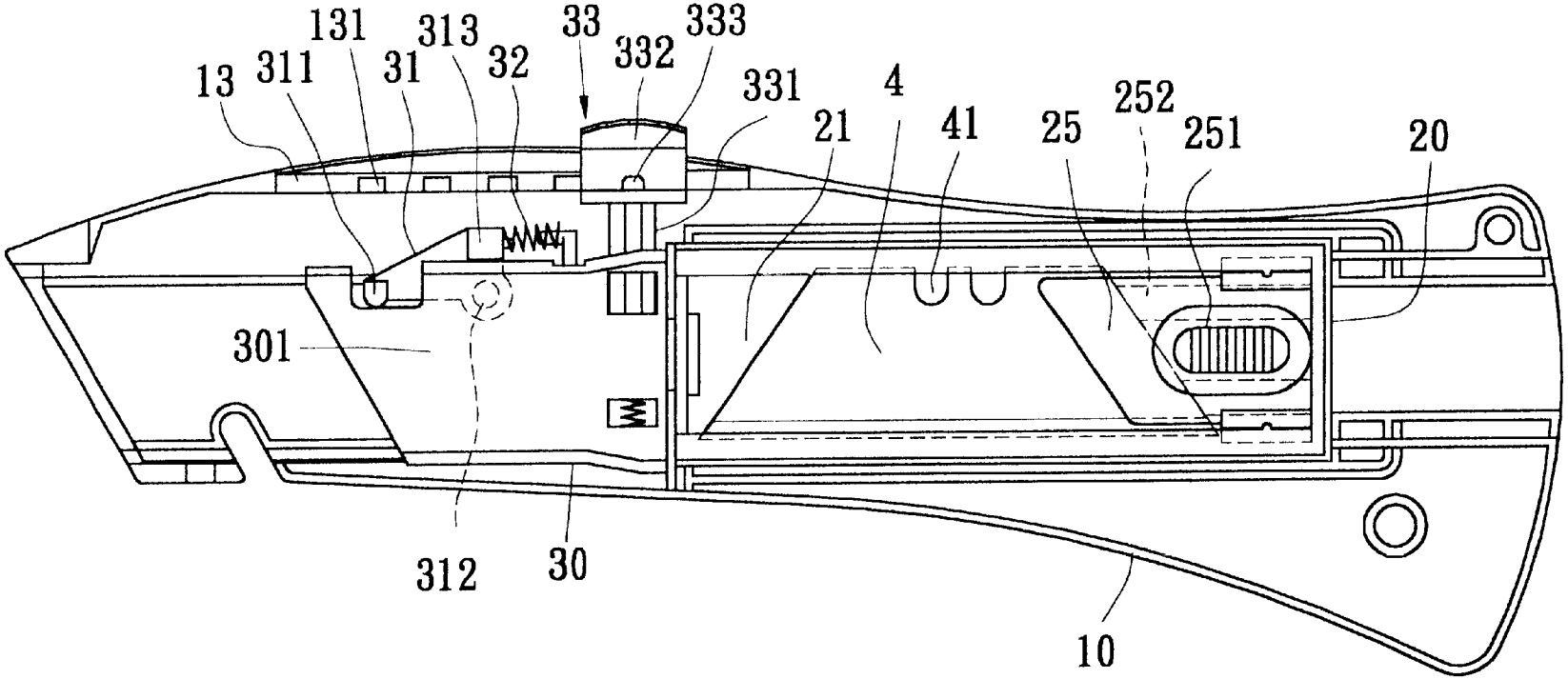
FIG. 5 is a plane view showing that the blade magazine and the blade seat are assembled with the handle of the present invention.
Figure 5A:
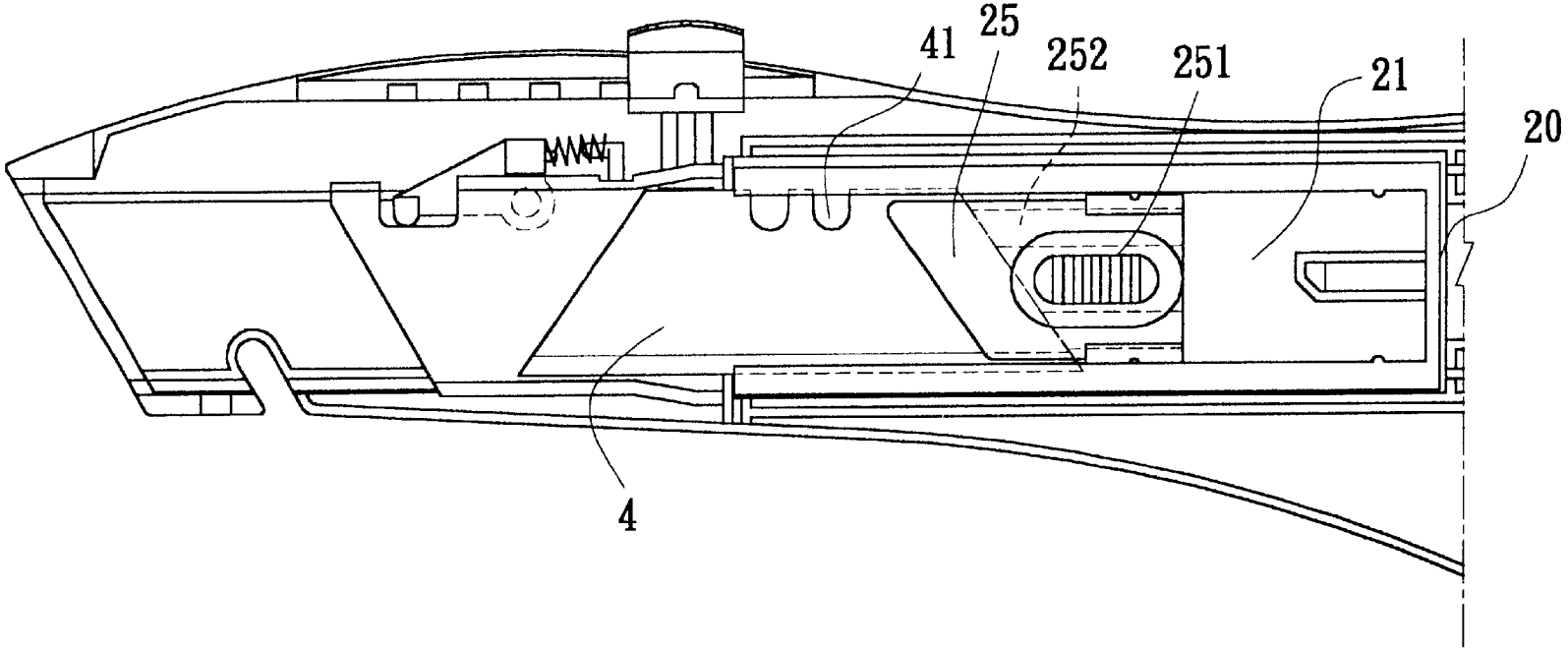
FIG. 5A shows that the pushing member of the present invention pushes the blade out of the blade magazine to the blade seat.
Figure 5B:
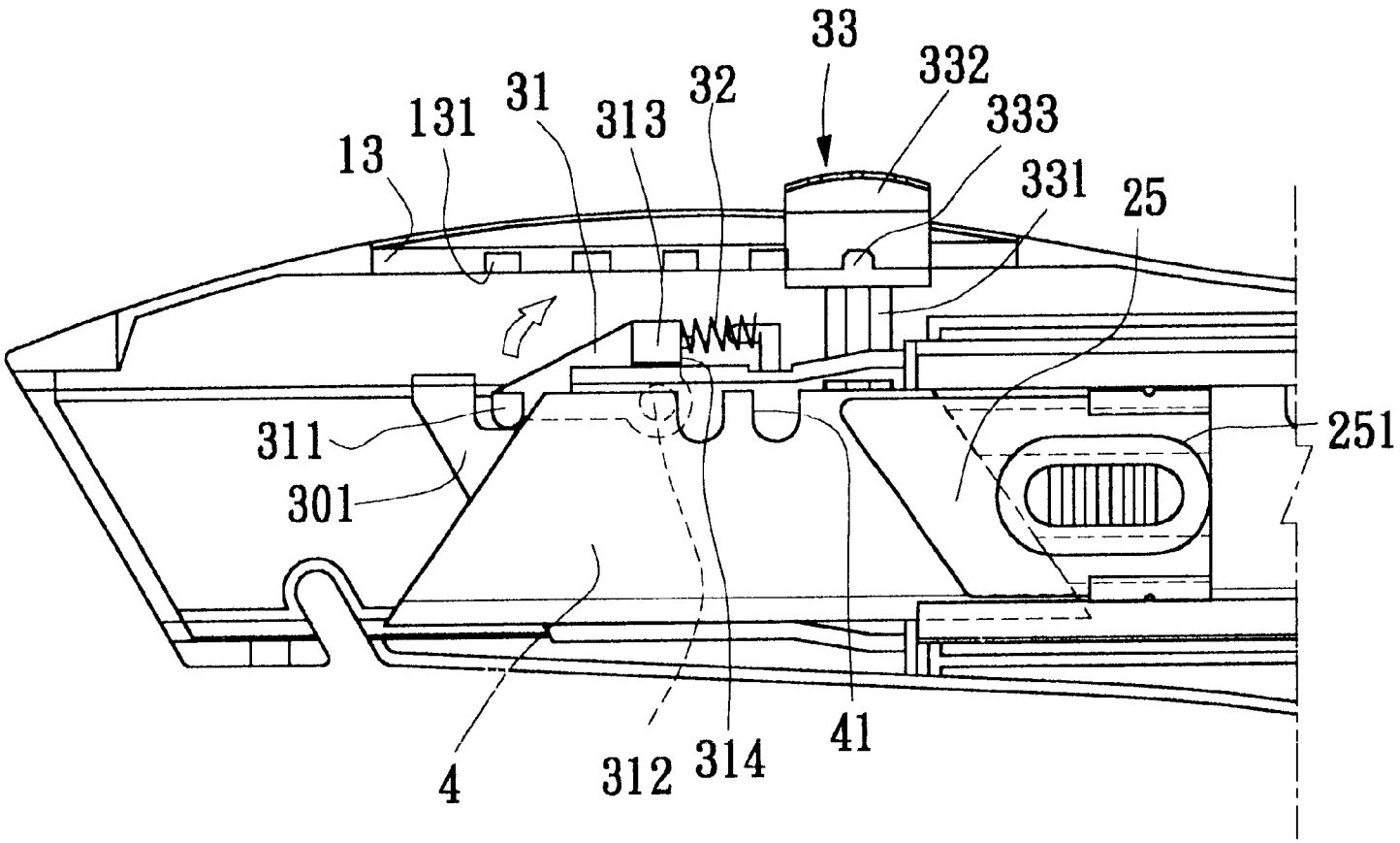
FIG. 5B shows that the pushing member of the present invention pushes the blade to push the hook section of the latch hook of the blade seat.
Figure 5C:
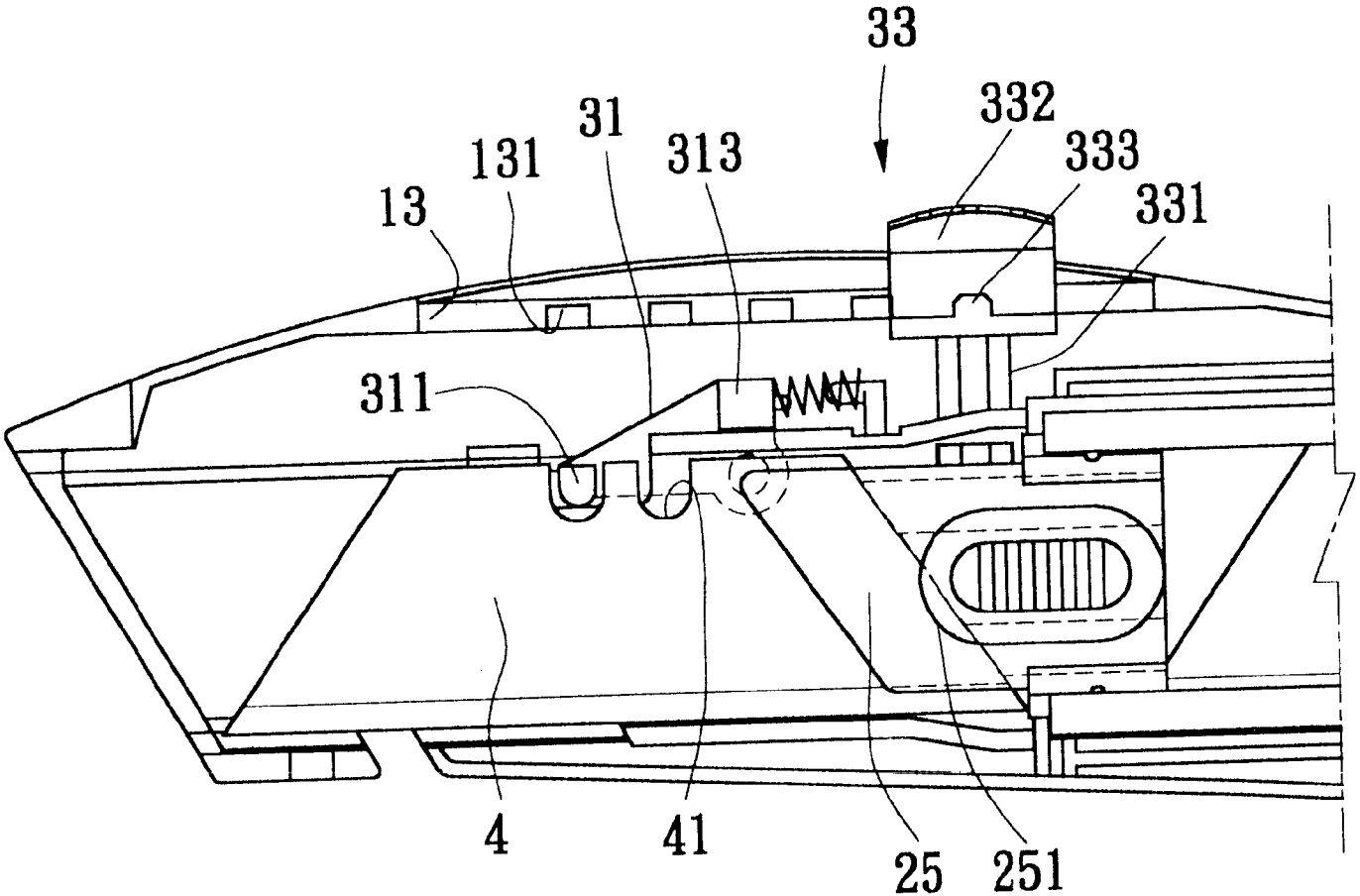
FIG. 5C shows that the pushing member pushes the blade to make the hook section of the latch hook of the blade seat engage into the blade.
Figure 5D:
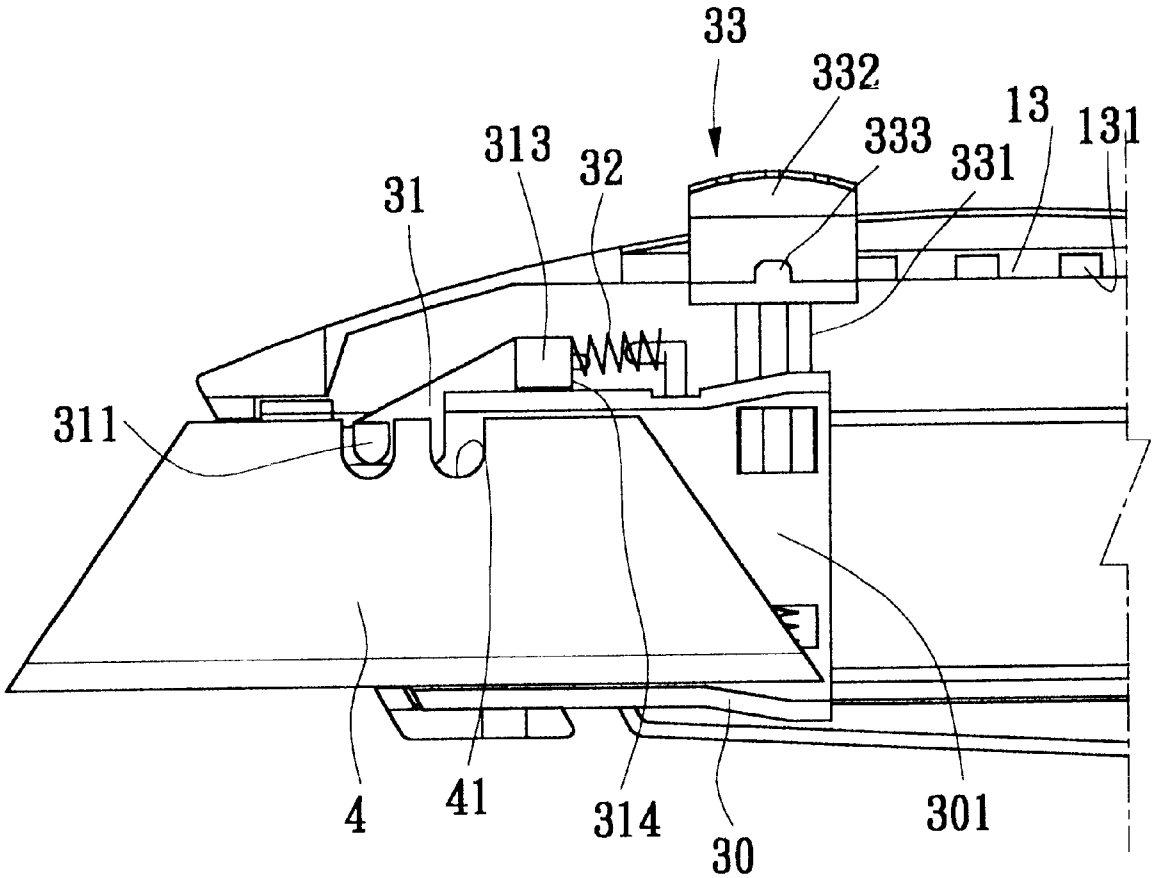
FIG. 5D shows that the blade is pushed out of the handle for use.
Figure 5E:
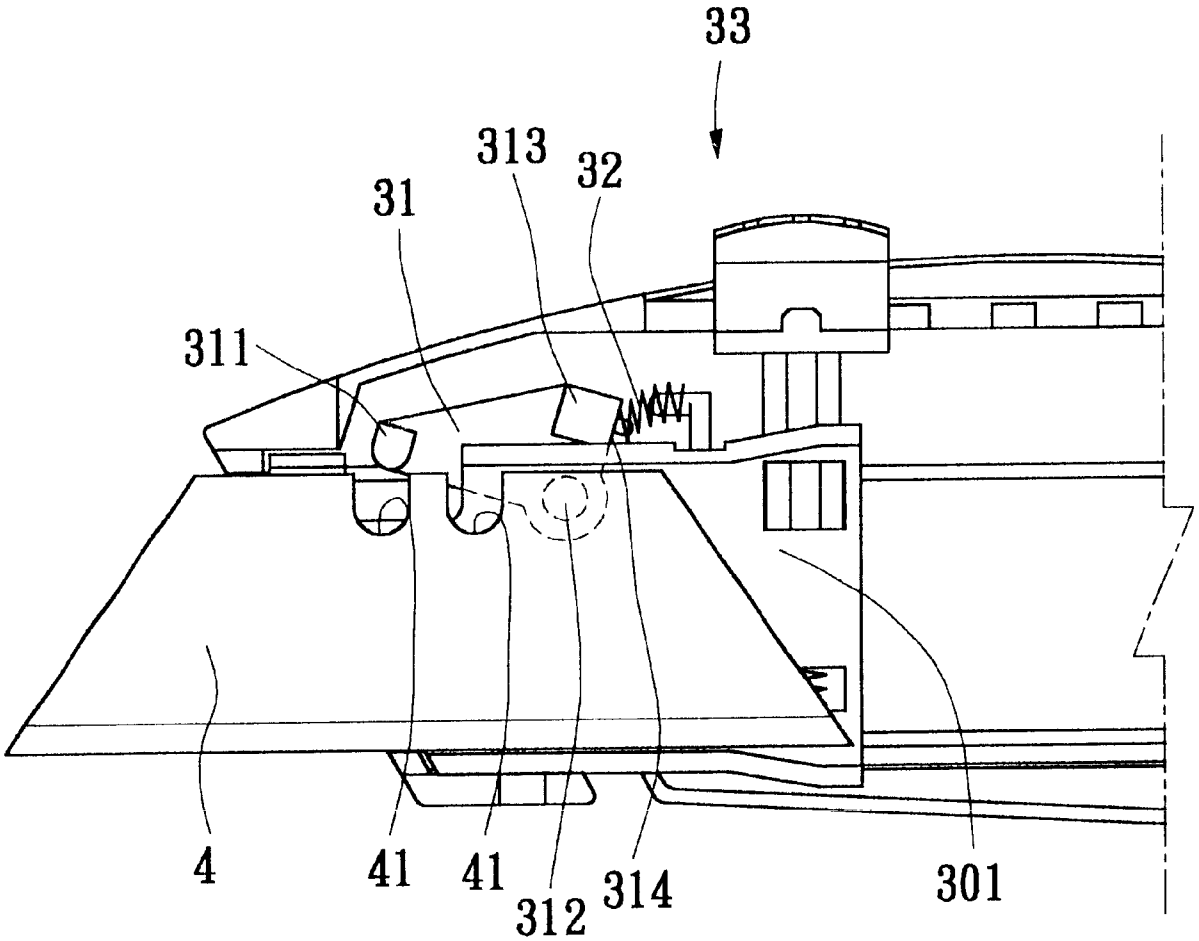
FIG. 5E shows that the press button is pressed against the guide slope face to force the hook section to separate from the notch of the blade.
Figure 6:
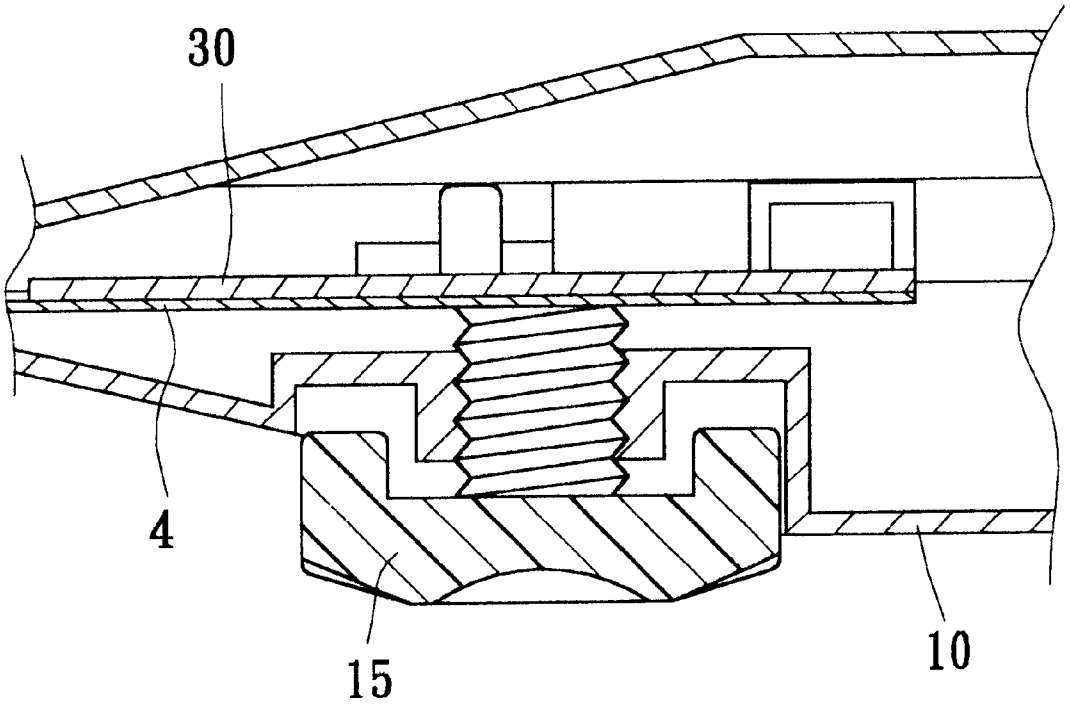
FIG. 6 is a sectional view taken along line VI—VI of FIG. 1, showing that a fixing bolt fastens the blade at front end of the handle.

Referring to FIGS. 5 to 5E, when armed, the pushing member pushes a blade out of the blade magazine to the blade seat and fixes the blade. Then the push button 332 is pushed to via a pushing member 33 make the blade seat 30 move forward to extend the blade out of the handle for use. In some cases, in order to stabilize the blade, as shown in FIG. 6, a fixing bolt 15 is disposed on one side of front end of the handle for fastening the blade on the blade cavity 301 of the blade seat.

When unarmed, the press button is pressed down and pressed against the guide slope face of the latch hook 31. The hook section of the latch hook 31 is forced to separate from the notch of the blade. When again armed, the above operation is repeated to make the pushing member push a blade out of the blade magazine.

According to the above arrangement, the blades 4 are previously loaded in the blade magazine 20. A user can prepare multiple blade magazines for replacement. In addition, the blade magazine 20 provides blades for the blade seat 30 only by means of the guiding of the blade cavity 301 so that the correctness of assembly can be easily controlled. Moreover, the entire blade magazine unit will not provide a retaining force for the blade in cutting so that the blade can be supplied accurately.

Figure 8:
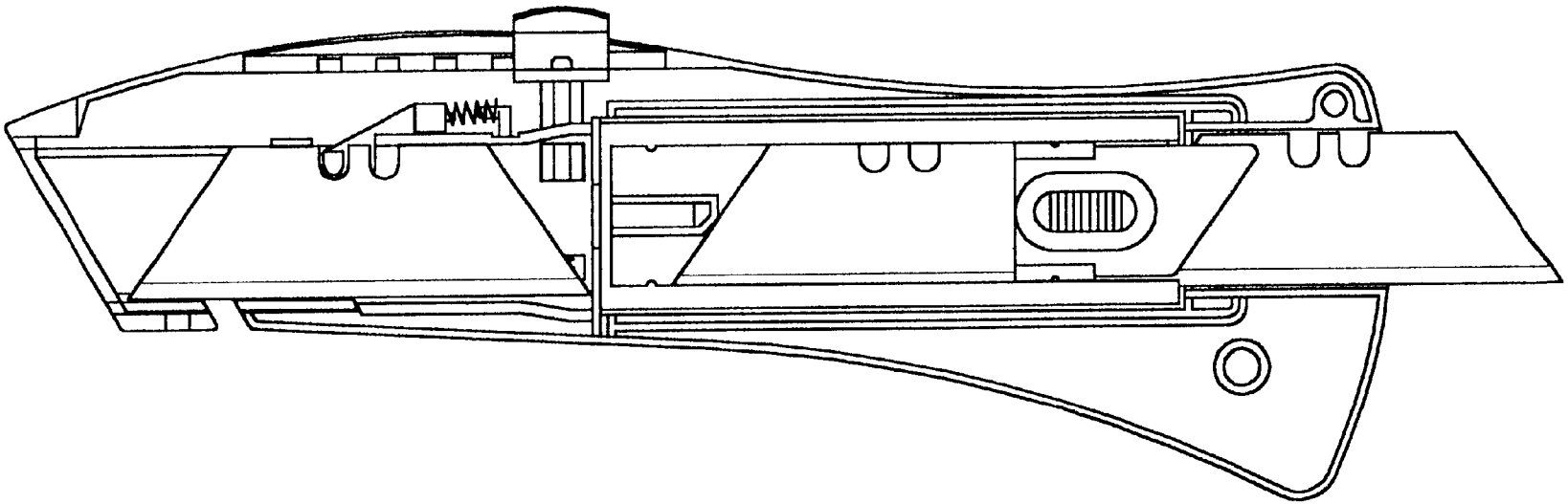
FIG. 8 shows that the blade magazine is turned to aim the opening of front end at the passage to push out the blade.
Figure 9:
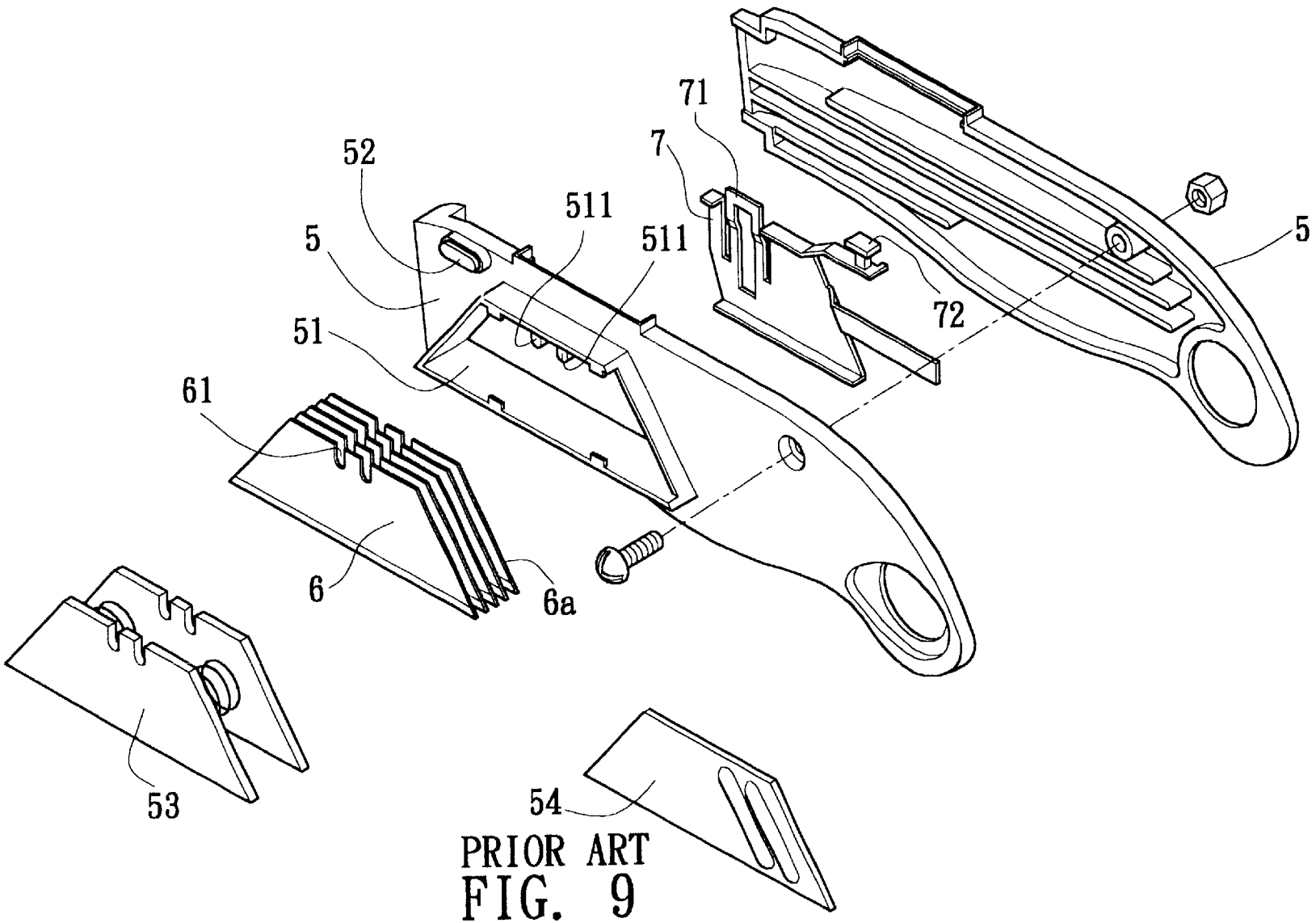
PRIOR ART FIG. 9
FIG. 9 is a perspective exploded view of a conventional artistic knife.
Figure 10:
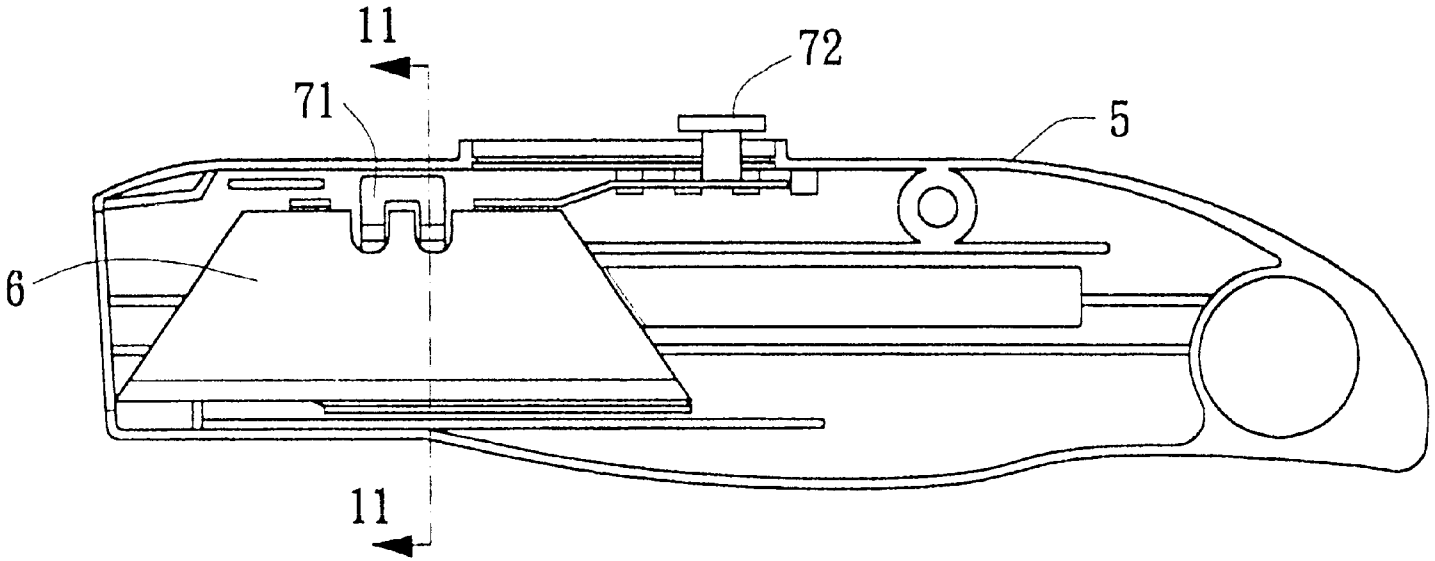
PRIOR ART FIG. 10
FIG. 10 is a plane assembled view of internal structure of the conventional artistic knife.
Figure 11:
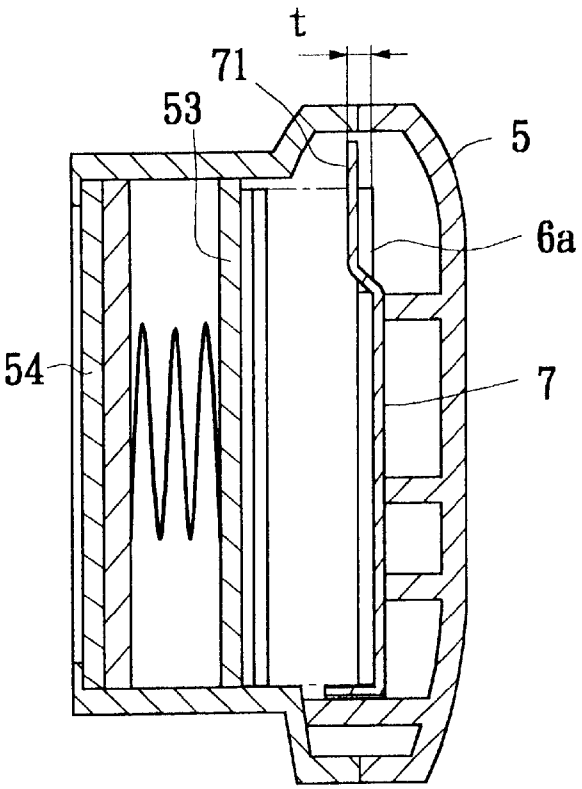
PRIOR ART FIG. 11
FIG. 11 is a sectional view taken along line X—X of FIG. 9, showing the blade and blade seat.

Another advantage of the present invention resides in that the rear end of the handle 10 can be formed with a passage 16 communicating with the blade magazine 20. In case the blade seat 30 fails to directly cooperate with the blade magazine 20 in arming operation, the blade magazine 20 can be turned to aim the opening 26 of front end at the passage 16 (as shown in FIG. 8). Under such circumstance, when pushed outward, the blade can pass through the passage 16 and be taken out and inserted into the front end of the handle to complete the arming operation.

The above embodiments are only used to illustrate the present invention, not intended to limit the scope thereof. Many modifications of the above embodiments can be made without departing from the spirit of the present invention.

What is claimed is:

1. An artistic knife with a replaceable blade magazine comprising:

a handle, said handle having a blade magazine and a blade seat, said blade magazine supplying blades for said blade seat through an open front edge thereof, said handle having a receptacle formed therein, said blade magazine being received within said receptacle, said blade magazine being formed with an internal reservoir for receiving a plurality of overlapped blades, said reservoir having an open edge, a resilient member being disposed along a bottom surface of said reservoir, said reservoir having a stop flange formed along said open edge of said reservoir, said stop flange extending along a transverse length of said blade magazine and being spaced apart from an upper side of a top edge of said reservoir by a distance substantially equal to the thickness of one of said blades, an upper edge of said stop flange having a long channel formed therethrough;

a first pushing member received within said long channel, a pushing block projecting from a first surface of said first pushing member, said pushing block extending past an outer surface of said handle, a second surface of said pushing member being disposed with a projecting stop wall, said projecting stop wall abutting against a rear edge of a first blade, said first pushing member being used to push said first blade through said open front edge of said blade magazine;

an axial long slide way formed on an inner surface of said handle, said blade seat being movably received therein, a first side of said blade seat being formed with a blade cavity, a bottom edge of said blade cavity corresponding to a plane face of said top edge of said reservoir of said blade magazine, a latch hook being disposed on an upper edge of said blade cavity, a top edge of each of said blades being formed with at least one notch for a hook section of said latch hook to engage, said latch hook being pivotally disposed on a back surface of said blade seat, said latch hook being held in an engaged position, said latch hook having a guiding slope face and a swinging face angularly displaced from one another;

a press button being disposed on said outer surface of said handle and being positioned adjacent to said guiding slope face, said press button selectively contacting said guiding slope face to disengage said hook section from said notch of said blade, said blade seat being pushed forward or backward along said axial long slide way by a second pushing member, a top edge of said blade seat being formed with a longitudinal guide channel in which said second pushing member is received, said second pushing member having a longitudinal bar in which a spring is positioned to slide within said guide channel, an upper surface of said handle being formed with a guide slot, a push button being disposed along an upper edge of said second pushing member within said guide slot, said guide slot having a plurality of engaging dents formed along a bottom edge thereof, opposing sides of said push button being formed with laterally extending projecting blocks for engaging said engaging dents.

2. An artistic knife with a replaceable blade magazine as recited in claim 1, wherein front edges of opposing sides of said reservoir of said blade magazine are respectively disposed with two sloping members, each of said sloping members having upper edges positioned on said top edge of said reservoir, a front edge of said blade contacting said sloping member to sequentially move forward to said open front edge of said blade magazine.

3. An artistic knife with a replaceable blade magazine as recited in claim 1, wherein said latch hook is held in an engaged position wherein a pushing section is disposed on one side of said latch hook with a pivot shaft, said pushing section being pushed by a spring, said pushing section being positioned on a lateral side of an end section of said guiding slope face, whereby when said guiding slope face is pushed by said push button, a deflecting direction thereof forces said pushing section to push back said spring to force said hook section to separate from said notch of said blade.

4. An artistic knife with a replaceable blade magazine as recited in claim 1, wherein said blade cavity of said blade seat has a diverging open end near said blade magazine.

5. An artistic knife with a replaceable blade magazine as recited in claim 1, wherein a fixing bolt is disposed on one surface of a front end of said handle for fastening said blade to said blade cavity of said blade seat.

6. An artistic knife with a replaceable blade magazine as recited in claim 1 wherein a rear end of said handle is formed with a passage communicating with said blade magazine, whereby said blade magazine can be turned to aim said open front edge at said passage, and when pushed outward, said blade can pass through said passage and be removed.

* * * * *